United States Patent [19]

Shimura

[11] Patent Number: 4,501,484

[45] Date of Patent: Feb. 26, 1985

[54] PHOTOCONDUCTIVE ELEMENT CLEANING APPARATUS AND RESIDUAL TONER COLLECTING APPARATUS

[75] Inventor: Akira Shimura, Tokyo, Japan

[73] Assignee: Ricoh Company, Ltd., Tokyo, Japan

[21] Appl. No.: 406,831

[22] Filed: Aug. 10, 1982

[30] Foreign Application Priority Data

| | | | |
|---|---|---|---|
| Aug. 19, 1981 | [JP] | Japan | 56-123285[U] |
| Aug. 19, 1981 | [JP] | Japan | 56-130663 |
| Aug. 19, 1981 | [JP] | Japan | 56-130662 |
| Dec. 19, 1981 | [JP] | Japan | 56-189589[U] |

[51] Int. Cl.[3] ..... G03G 15/08

[52] U.S. Cl. ..... 355/15; 355/3 DD

[58] Field of Search ..... 355/3 R, 15, 3 DD, 14 D, 355/3 BE; 118/652

[56] References Cited

U.S. PATENT DOCUMENTS

| | | | |
|---|---|---|---|
| 3,893,416 | 7/1975 | Eichorn et al. | 355/15 X |
| 4,067,018 | 1/1978 | Pond | 355/15 X |
| 4,298,268 | 11/1981 | Sato et al. | 355/15 X |
| 4,370,056 | 1/1983 | Hays | 355/3 BE X |
| 4,398,820 | 8/1983 | Thayer | 355/15 |

*Primary Examiner*—A. C. Prescott

*Attorney, Agent, or Firm*—David G. Alexander

[57] ABSTRACT

Residual toner carried on the imaging surface of a photoconductive belt is removed by a cleaning sleeve, conveyed to a toner discharging station and let fall through an opening into a removable container. A spring biased closure member stops the opening when the container is removed for disposal, thereby preventing contamination to the adjacent structural elements. Means is provided for urging one to position the container always in a predetermined orientation relative to the opening at the toner discharging station. Undesirable particles entrained by the other surface of the belt is collected by a counter member which is located at the opposite side to the cleaning sleeve with respect to the belt. The counter member may take the form of a block of soft material or bristles carried on a support member.

16 Claims, 18 Drawing Figures

PHOTOCONDUCTIVE ELEMENT CLEANING APPARATUS AND RESIDUAL TONER COLLECTING APPARATUS

BACKGROUND OF THE INVENTION

The present invention relates to an apparatus for cleaning a photoconductive element and an apparatus for collecting residual toner both installed in an electrophotographic copying machine or the like.

In electrophotographic copying machines or the like using a photoconductive element, particularly one in the form of a belt, a cleaning apparatus is installed to clear a photoconductive element of toner particles remaining thereon after the transfer of a toner image onto a sheet. A known type of cleaning apparatus includes a cleaning member constituted by a roller on which bristles are set and which has magnets thereinside. A counter member is formed of a soft material and located at the back of a belt in facing relation with the cleaning member. A photoconductive element is held between the cleaning member and the counter member while the cleaning member is kept in pressing contact with the photoconductive element. In this type of prior art cleaning apparatus, the cleaning member is required to clean the photoconductive element in even and soft contact with the surface of the latter. To set up an even pressure distribution between the cleaning member and the belt, that surface of the counter member which engages with the back of the belt needs be processed to a high precision. Poor flatness of the mentioned surface of the counter member would make the pressure distribution irregular; in a lower pressure area, cleaning would be incomplete while, in a higher pressure area, either surface of the belt would be worn out or shaved off to deteriorate the strength of the belt or even the recording characteristics thereof. Usually, the base of a belt is formed of an organic material such as a polyester film or an inorganic material such as a stainless steel sheet. During repeated movements of the belt, the base of the material is progressively shaved off and the resulting particles are deposited on the belt. Thease particles are entrained by the belt to adhere to the surface of a drive roller which is engaged with the belt, reducing the friction between the belt and the drive roller. Furthermore, the particles shaved off the belt are deposited on the counter member to disturb the even contact of the belt surface with the cleaning member. Shaving of the base of the belt per ce causes such uneven contact between the cleaning member and the belt as well as a decrease in the drive transmission force from the drive roller. A solution heretofore proposed to this problem is the provision of an additional cleaning member which is engaged with the back of the belt. This, however, results in the intricacy of construction and increase in cost.

In the meantime, the residual toner removed from the belt surface by the cleaning apparatus is discharged from the cleaning apparatus by toner discharging means which comprises a toner discharge casing, a screw disposed inside the casing, etc. The residual toner is then collected in a container to be wasted. When filled up with the toner, the container is taken out from the machine and discarded. Vibration entailed by the removal of the container tends to allow the toner particles to drop from the vicinity of a toner outlet of the casing and/or from the toner outlet itself where they may form light bridges. Then, the toner would contaminate various parts located below the casing or even affect their functions.

After the filled container has been unloaded from the machine, a new empty container has to be loaded. Should one forget to load an empty container, the toner discharged from the toner outlet during operation of the machine would drop onto the parts located below to invite the same results as the above-stated.

Furthermore, when the orientation of the container inside the machine is incomplete or inverted, the toner discharged from the toner outlet will partly miss the container to contaminate the interior of the machine due to the asymmetrical shape of the container. Though such an accident may be avoided if a stop or the like is used to prevent the container from being oriented improperly, this adds to the number of structural elements and, therefore, the production cost.

SUMMARY OF THE INVENTION

It is an object of the present invention to eliminate the above-described various drawbacks inherent in the prior art apparatuses for cleaning a photoconductive element and collecting residual toner.

It is another object of the present invention to provide a photoconductive element cleaning apparatus which permits a cleaning member to engage with the surface of a photoconductive element under even pressure to prevent the back of the photoconductive element from being worn out or damaged.

It is another object of the present invention to provide a new toner collecting apparatus which prevents toner particles from being irregularly scattered or dropped due to vibration which would occur during movement of a container into or out of a machine and, thereby, keep the interior of the machine clean.

It is another object of the present invention to provide a new toner collecting apparatus which causes an empty container to be surely loaded in the machine after the removal of a filled container.

It is another object of the present invention to provide a new toner collecting apparatus which readily senses misorientation of a container inside a machine.

It is another object of the present invention to provide generally improved apparatuses for cleaning a photoconductive element and for collecting residual toner.

Other objects, together with the foregoing, are attained in the embodiments described in the following description and illustrated in the accompanying drawings.

DESCRIPTION OF THE PREFERRED EMBODIMENTS

While the photoconductive element cleaning apparatus and residual toner collecting apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
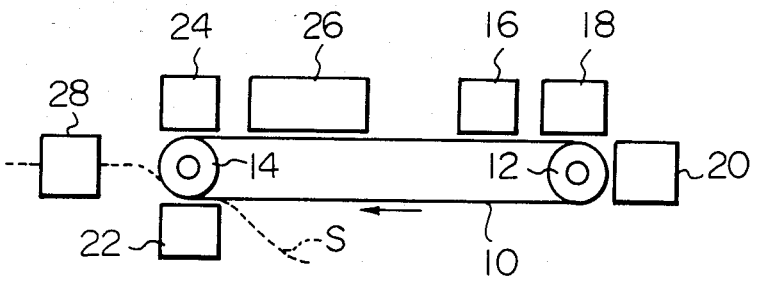
FIG. 1 is a schematic view of an electrophotographic copying machine equipped with a cleaning apparatus embodying the present invention.

Referring to FIG. 1 of the drawings, an electrophotographic copying machine is schematically shown which uses a photoconductive element in the form of a belt to which the cleaning apparatus of the present invention is applicable. The copying machine comprises a photoconductive belt 10 passed over a drive roller 12 and a driven roller 14 to be moved in the direction indicated by an arrow. The photoconductive belt 10 may be a belt with or without ends. Disposed around the belt 10 are a charging unit 16, an exposing unit 18, a developing unit 20, a transferring unit 22, a discharging unit 24 and a cleaning unit 26. In the illustrated arrangement, the developing unit 20 employs magnet brush development for which a magnetic toner is used as a developer. A latent image electrostatically formed on the belt 10 is processed by the developing unit 20 into a toner image which is then electrostatically transferred onto a sheet S by the transferring unit 22. The sheet S carrying the toner image is separated from the belt 10 and conveyed to a fixing unit 28 to have the toner image fixed permanently thereon. The discharging unit 24 clears the belt 10 of needless residual charge while the cleaning unit 26 removes the residual toner.

Figure 2:
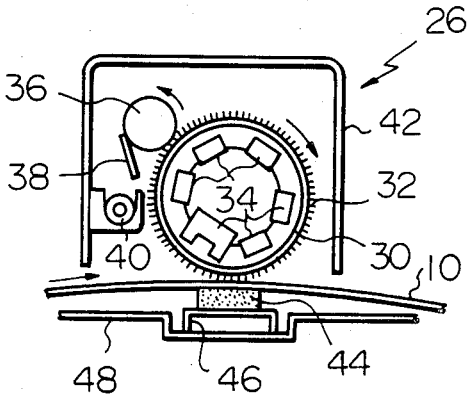
FIG. 2 is a sectional side elevation showing details of the cleaning apparatus indicated in FIG. 1.

Referring to FIG. 2, the cleaning unit or apparatus 26 includes a cylindrical sleeve 30 formed of a non-magnetic material and rotatable clockwise as indicated by an arrow. Short bristles 32 made of nylon or rayon, for example, are set on the outer periphery of the sleeve 30. Permanent magnets 34 are fixed in place within the sleeve 30. A magnetic roller 36 is positioned above and to the left of the sleeve 30 to be engaged by the bristles 32 on the sleeve 30, the roller 36 being counterclockwise as also indicated by an arrow. A scraper 38 is pressingly engaged with the periphery of the magnetic roller 36. Located below the scraper 38 is a toner discharging means 40 for toner collection which may comprise a screw or a spiral blade, as will be described in detail. The sleeve 30, roller 36, toner discharging means 40 and other associated elements are installed in a casing 42 which is open toward the belt 10. A counter member 44 is positioned on the opposite side to the sleeve 30 with respect to the belt 10. The counter member 44 is made of a soft material such as felt, rubber, sponge or brush. The counter member 44 is mounted on a support member 46 which in turn rests on a base 48. Projecting above the top of the base 48, the counter member 44 is so mounted on the support 46 as to urge the belt 10 against the sleeve 30.

In operation, the sleeve 30 is engaged with the belt 10 which has passed through the image transfer station 22 so that the bristles 32 on the sleeve 30 agitate the residual toner on the belt 10. The bristles 32 remove the toner from the belt 10 and entrain almost all the toner therewith. Where the toner is a magnetic toner, the magnets 34 placed within the sleeve 30 as in the illustrated embodiment will effectively help the residual toner be removed from the surface of the belt 10 or attracted onto and carried by the sleeve 30 due to their magnetic attraction. The magnetic field between the magnets 34 and the magnetic roller 36 causes the toner thus deposited on the sleeve 30 to be transferred onto the roller 36. The scraper 38 scrapes the toner off the roller 36 and let it fall onto the toner discharging means 40, which conveys the removed toner out of the cleaning apparatus 26.

The counter member 44 and support member 46 extend over substantially a same width as the belt 10 and is so adjusted in position that the belt 10 be engaged by the bristles 32 on the sleeve 30 evenly throughout the width.

The support member 46 may be formed of a magnetic material and arranged to be movable up and down. This will cause the support member 46 to be attracted toward the sleeve 30 by the magnetic force of the magnets 34 in the sleeve 30, so that the belt 10 is engaged with the sleeve 30 by the counter member 46. The contact pressure depends on the magnetic force of the magnets 34, the distance between the magnets 34 and the support member 46, etc.

Figure 3:
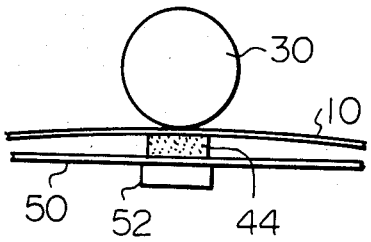
FIG. 3 is a fragmentary sectional side elevation of a second embodiment of the cleaning according to the present invention.

Referring to FIG. 3, there is shown a second embodiment of the cleaning apparatus of the present invention. In this embodiment as well as others which will follow, the same parts and elements as those shown in FIG. 2 will be designated by the same reference numerals and will not be described any further for the sake of simplicity.

In FIG. 3, the support member 46 and base 48 are constituted integrally by a single flat support member 50. The counter member 44 is mounted on the support member 50. While the support member 50 is made of a non-magnetic material, a magnetic plate 52 is carried on the underside of the support member 50 to enhance the cleaning effect provided by the magnets. As in the first embodiment, the counter member 44 projects above the support member 50 so that a suitable gap or space is defined between the belt 10 and the support member 50. With this arrangement, particles of dust and toner removed by the counter member 44 from the belt 10 will be deposited in the space and prevented from being carried by the belt 10.

Figure 4:
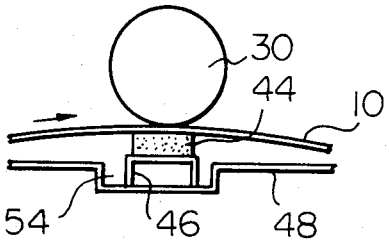
FIG. 4 is a fragmentary sectional side elevation of a third embodiment of the cleaning apparatus according to the present invention.

Referring to FIG. 4, a third embodiment of the cleaning apparatus of the present invention is shown. This embodiment is similar to the first embodiment in basic construction but differs therefrom concerning that part of the base 48 which holds the support member 46. The base 48 in FIG. 4 defines a space 54 in a position ahead of the counter member 44 with respect to the direction of movement of the belt 10. The space 54 serves to collect the toner and like particles therein. The support member 46 is placed in a recess which is formed in the base 48 to such a shape as shown in the drawing. As the belt 10 moves as indicated by an arrow, the counter member 44 and support member 46 are moved by the belt 10 in the same direction whereby a leg of the support member 46 becomes positioned by the right edge of the recess of the base 48. The space 54 is defined in this manner to the left of the other leg of the support member 46. Again, the support member 46 may be formed of a magentic material.

Figure 5:
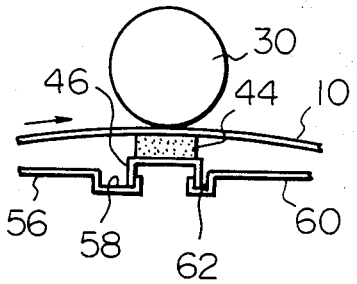
FIG. 5 is a fragmentary sectional side elevation of a fourth embodiment of the cleaning apparatus according to the present invention.

Referring to FIG. 5, a fourth embodiment of the present invention is shown in which the base is divided into two parts. Each base part is shaped to have a recess for supporting the support member 46 at its end which faces the end of the other base part. One 58 of the recesses is positioned ahead of the counter member 44 with respect to the direction of movement of the belt 10. The recess 58, apart from its supporting function, serves to collect the toner and other particles removed by the counter member 44 due to its substantial dimensions. The other recess or, rather, a groove 62 serves both the functions of positioning and guiding the support member 46. In detail, the groove 62 serves as a guide which facilitates the movement of the support member 46 out of the apparatus which will be required for maintenance purpose or replacement of the belt 10, for example. When the support member 46 is removed from the apparatus, the toner and like particles deposited in the recess 58 can be cleared.

Figure 6:
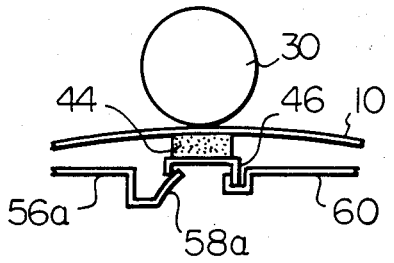
FIG. 6 is a sectional side elevation showing a modified form of a base included in the apparatus of FIG. 5.

A modified form of the embodiment shown in FIG. 5 is illustrated in FIG. 6. A recess 58*a* formed in a base 56*a* collects the needless particles removed from the belt 10 by the counter member 44. Here, the recess 58*a* is provided with an inclined wall to prevent the particles from adhering to the support member 46 when the support member 46 is moved into or out the apparatus.

Figure 7:
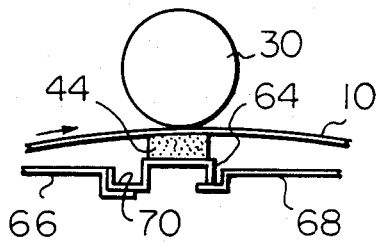
FIG. 7 is a fragmentary sectional side elevation of a fifth embodiment of the cleaning apparatus according to the present invention.

Referring to FIG. 7, a fifth embodiment of the present invention is shown which is common to the fourth embodiment in that a support member 64 is removably supported on two base parts 66 and 68. Different from the fourth embodiment, however, a part of the support member 64 defines a recess 70 for depositing the particles removed by the counter member 44. Naturally, the recess 70 is located ahead of the counter member 44 with respect to the direction of movement of the belt 10. Because the recess 70 is defined by the removable support member 64, the needless particles will be taken out when the support member 64 is removed, to facilitate cleaning work. The support member 64 may be designed disposable and wasted together with the counter member 44 whose service life is limited. For this purpose, the support member 64 should be made of an incostly material.

Figure 8:
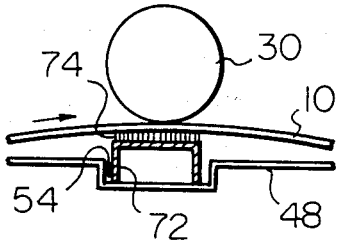
FIG. 8 is a fragmentary sectional side elevation of the sixth embodiment of the cleaning apparatus according to the present invention.

Referring to FIG. 8, a sixth embodiment of the present invention is shown. In this embodiment, a plate-like magnetic element 72 rests on the bottom of the space 65 which is defined in that part of the base 48 which faces the sleeve 30. The magnetic element 72 may comprise a magnet which is opposite in polarity to the magnets 34 housed in the sleeve 30. Short bristles 74, like the bristles 32 on the sleeve 30, are arranged on one surface of the magnetic element 72 which is engaged with the belt 10. The bristles 74 may be directly set on the magnetic element 72 or may be constituted by a cloth or any other suitable member with bristles and bonded to the magnetic element 72. Thus constructing the sleeve 30, belt 10 and magnetic element 72 will allow the magnetic element 72 to be attracted toward the magnets 34 in the sleeve 30 so that the belt 10 can be pressingly engaged with the sleeve 30 through the bristles 74. It will be seen that the bristles 74 cushion the belt 10 into even pressing contact with the surface of the sleeve 30, though the surface of the magnetic element 72 may not be strictly flat. Also, because the underside of the belt 10 is engaged not by the magnetic element 72 which is hard but by the bristles 74 which are soft, its wearing or shaving is minimized to prolong the life of the belt 10 while stabilizing the recording characteristics of the belt 10.

Figure 9:
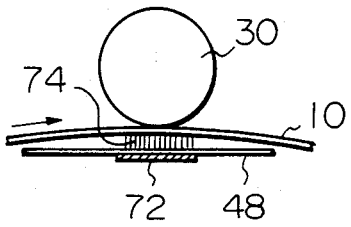
FIG. 9 is a fragmentary sectional side elevation of the seventh embodiment of the cleaning apparatus according to the present invention.

Referring to FIG. 9, a seventh embodiment of the present invention is shown which employs a flat and vertically movable base 48. The flat base 48 carries the short bristles 74 on its surface which faces the sleeve 30 and the magnetic element on the other or back surface. With this construction, the magnetic element 72 is attracted toward the sleeve 30 together with the base 48 by the magnets 34 housed in the sleeve 30. The belt 10, therefore, is held in pressing contact with the sleeve 30 by the bristles 74.

In the embodiments shown in FIGS. 8 and 9, the bristles 74 can be made of various materials depending on the strength and weight of the photoconductive element. Typical examples of such materials may be synthetic fibers such as nylon and rayon, natural fibers such as cotton and wool, and mineral fibers.

In all the first to seventh embodiments, while a magnetic toner has been used as a developer, it may be replaced by a non-magnetic toner. The non-magnetic sleeve with bristles is only illustrative and may be constituted by any other cleaning member as exemplified by a cleaning blade or a fur brush. Though the bristles on the sleeve 30 are not essential, they would afford a better cleaning effect and less wear of the recording element.

Now, various embodiments of the toner collecting apparatus of the present invention will be described which are all designed for collecting the residual toner removed from the belt surface by any one of the cleaning arrangements discussed hereabove.

Figure 10:
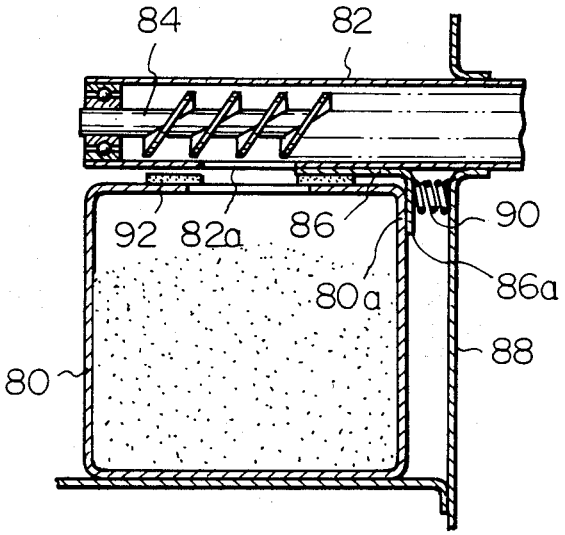
FIG. 10 is a sectional side elevation of a toner collecting apparatus also embodying the present invention.
Figure 11:
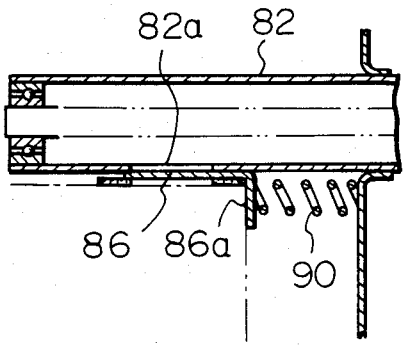
FIG. 11 is a fragmentary sectional side elevation of the apparatus shown in FIG. 10 illustrating the movement of a closure member.
Figure 12:
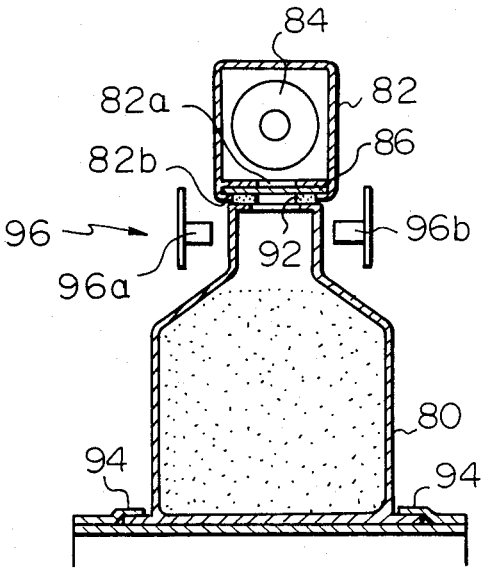
FIG. 12 is a sectional front view of the apparatus shown in FIG. 10.

Referring to FIGS. 10–12, the toner collector includes a toner discharge casing 82 interposed between the cleaning apparatus 26 and a position where a container 80 is removably mounted. Above the container mounting position, the casing 82 is formed with an opening 82*a* for dropping the toner which has been removed from the belt surface and conveyed by a screw 84. A closure member 86 made of a non-magnetic material is slidable along the direction of movement of the container 80 into and out of the collector, thereby selectively closing the opening 82*a*. The closure member 86 is guided by guide channels 82b formed in a bottom portion of the casing 82. The innermost end of the closure member 86 is bent to form an abutment 86a. A compression spring 90 is preloaded between the back of the abutment 86a and a rigid frame member 88 in order to constantly bias the closure member 86 to close the opening 82a. The gap between the opening 82a and the container 80 is sealed by seals 92. Guide plates 94 guide the container 80 when the latter is loaded or unloaded. Generally designated by the reference numeral 96 is a photoelectric sensor made up of a light emitting element 96a and a light receiving element 96b and adapted to sense a toner level collected in the container 80.

As the container 80 is pushed into the collector along the guides 94 as far as a predetermined position, its shoulder designated 80a pushes the abutment 86a against the action of the spring 90. Then the closure member 86 is moved to unblock the opening 82a of the casing 82.

When the container 80 has become filled up with the collected toner, such a condition is displayed on a panel (not shown) by an output signal of the sensor 96. At the same time or upon the lapse of a certain period of operation time thereafter, such as after the production of several hundreds of copies, the copying machine is disabled. As the container 80 is manually removed from the collector, the closure member 86 released from the shoulder 80a of the container 80 is moved to the left in the drawing by the spring 90 to the position indicated in FIG. 11. In this position, the closure member 86 blocks the opening 82a to prevent the toner from dropping from the casing 82.

Figure 13:
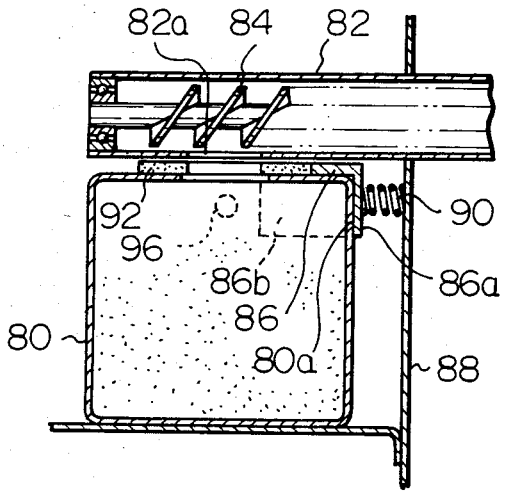
FIG. 13 is a sectional side elevation of a second embodiment of the toner collecting apparatus according to the present invention.
Figure 14:
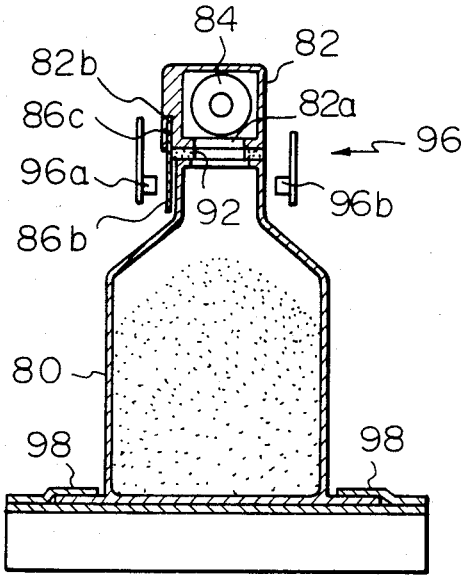
FIG. 14 is a sectional front view of the apparatus shown in FIG. 13.

Referring to FIGS. 13 and 14, an alternative form of the toner collector of the present invention is shown in which the same parts and elements as those of the first embodiment are denoted by the same reference numerals. In FIGS. 13 and 14, a light intercepting plate 86b is slidably received in a guide channel 82b which is formed in a side wall of the casing 82. When the closure member 86 closes the opening 82a of the casing 82, the light interceptor 86b will intercept the transmission of light from the light emitting element 96a to the light receiving element 96b. As shown, the light emitting element 96a and light receiving element 96b in this embodiment are located to face each other through an upper part of the container 80 and the light interceptor 96b. Again, the container 80 is guided by guide plates 98 when moved into or out of the collector.

In the arrangement shown in FIGS. 13 and 14, as the container 80 is pushed into a predetermined position along the guides 98, its shoulder 80a urges the abutment 86a against the force of the compression spring 90 so that the closure member 86 is moved to the position shown in FIG. 13, where it blocks the opening 82a of the casing 82. Such a movement of the closure member 86 brings the light interceptor 86b on one side of the closure member 86 out of the optical path of the sensor 96. Then, the light from the light emitting element 96a becomes incident on the light receiving element 96b so that the machine is abled in response to an output of the element 96b. When the container 80 has been filled up with the collected toner, this condition is displayed on the panel and the machine is disabled with or without a certain delay as in the embodiment described with reference to FIGS. 10–12. Taking the container 80 out of the collector to empty it releases the closure member 86 from the shoulder 80a. This causes the closure member 86 to move to the left in the drawing under the action of the compression spring 90, thereby blocking the opening 82a of the casing 82. In this situation, not only the drop of the toner from the casing 82 is prevented, but the drop of the toner attributable to erroneous operation is checked because the optical path of the sensor 96 is intercepted to make the machine inoperable.

Figure 15:
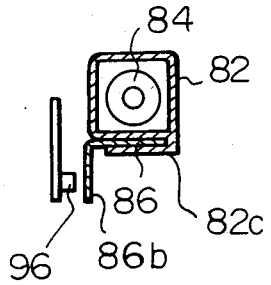
FIG. 15 is a fragmentary sectional side elevation of an exemplary arrangement for guiding a closure member.

FIG. 15 illustrates an example of a guide mechanism for the closure member 86. As shown, the guide mechanism comprises a guide channel 82c which is formed in the bottom wall of the casing 82.

Figure 16:
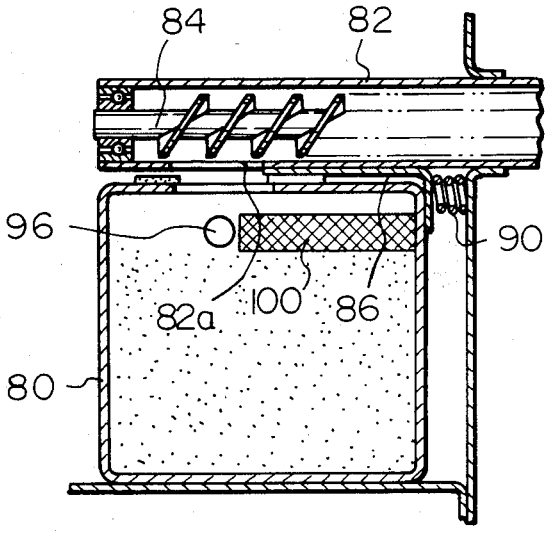
FIGS. 16 and 17 are a sectional side elevation and a sectional front view of a third embodiment of the toner collecting apparatus according to the present invention, respectively.
Figure 17:
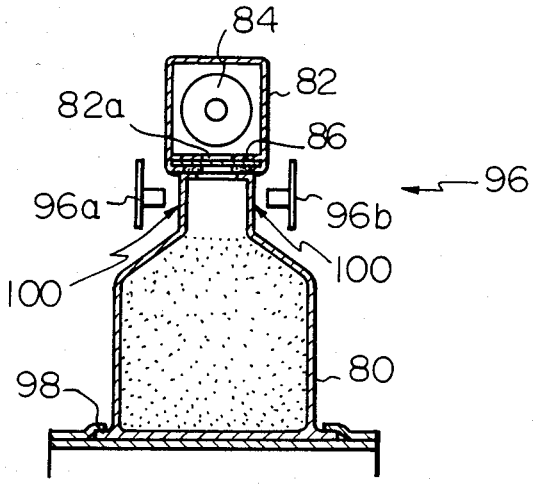

Referring to FIGS. 16 and 17, a third embodiment of the toner collector of the present invention is shown. Light interceptors 100 in the form of seals or marks are bonded to or printed on laterally opposite upper surfaces of the container 80. The positions of the light interceptors 100 are such that, in a proper position of the container 80 inside the collector, they do not interfere with the optical path of the sensor 96, that is, the positions offset either to the front or the rear (front in this embodiment).

Where the orientation of the container 80 loaded in the collector is proper, the light interceptors 100 are located outside the optical path of the sensor 96 so that the light receiving element 96b coactive with the light emitting element 96a makes the machine operable with its output.

As the container 80 becomes filled up with the collected toner, the machine is disabled through the procedure described in connected with the foregoing embodiments. Then, the container 80 is taken out of the collector to be replaced with another. If the new container is misoriented inside the machine, the light interceptors 100 on the container 80 will block the optical path of the sensor 96 to disable the machine and, thereby, prevents the fall of to toner.

Figure 18:
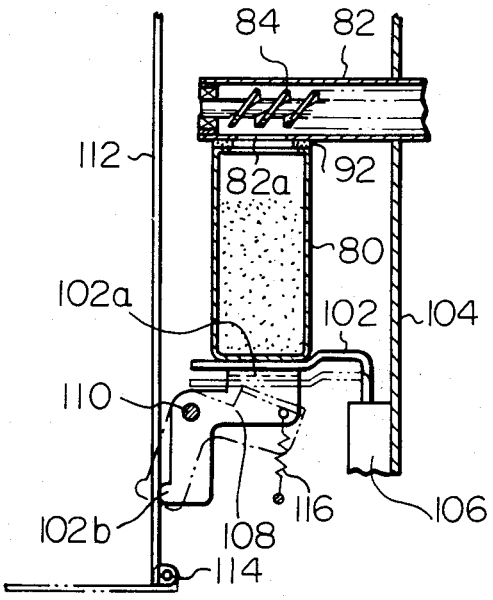
FIG. 18 is a sectional side elevation of a fourth embodiment of the toner collecting apparatus according to the present invention.

Referring to FIG. 18, there is shown a fourth embodiment of the toner collector in which the container 80 is removably laid on a plate 102. The plate 102 is vertically movable along a guide plate 106. A bellcrank lever 108 is pivotable about a pin 110 and supports the plate 102. One arm of the bellcrank lever 108 is bent at its free end to form a surface 102a which is engagable with the lower surface of the plate 102, while the other arm is formed with a lug 102b which is engagable with the inner surface of a cover 112 of the machine body. When the cover 112 is moved about a hinge 114 to its closing position, the lever 108 engaged with its surface will be moved counterclockwise to push the plate 102 upwardly until the mouth of the container 80 becomes abutted against the edge of the opening 82a through seals 92. The lever 108 is constantly biased clockwise by a spring 116.

When the cover 112 is opened about the hinge 114 to take out the container 80, the lever 108 having been supported by a part of the cover surface is rotated clockwise about the pin 110 by the spring 116. Then, the plate 102 is moved downwardly by gravity carrying the container 80 thereon, whereby the mouth of the container 80 moves clear of the edge of the opening 82a. Accordingly, if the toner deposited on the casing 82 around the opening 82a drops during the removal of the container 80, it will safely be collected in the container 80 with the interior of the collector thus kept clean. Meanwhile, a spacing of about several to 10 mm is defined between the casing 82 and the mouth of the container 80 upon the downward movement of the plate 102. This spacing permits the cleaning apparatus 26 connected with the casing 82 to be readily moved into or out of the machine without removing the container 80.

As the cover 112 is closed with the new container 80 laid on the plate 102, it moves the lever 108 counterclockwise about the pin 110 against the action of the spring 116 thereby raising the container 80 through the plate 102 to a position where the seals 92 lightly abut against the casing 82.

While various embodiments of the toner collector of the present invention have been shown and described in connection with an electrophotographic copying machine, it will be apparent that they are similarly applicable to any other type of recording machine such as an electrostatic or magnetic recording machine. The photoelectric sensor 96 may naturally be substituted for by a microswitch, a magnetic sensor or the like.

Various modifications will become possible for those skilled in the art after receiving the teachings of the present disclosure without departing from the scope thereof.

What is claimed is:

1. A cleaning apparatus for cleaning a moving photoconductive belt to remove residual toner therefrom, comprising:

a rotatable cleaning member for removing the residual toner from the imaging surface of the belt;

a counter member located at the side of the belt opposite to the imaging surface to face the cleaning member through the belt; and a support member for supporting the counter member and urging the counter member against the back surface of the belt while the apparatus is operated;

the cleaning member comprising a non-magnetic cylindrical sleeve having relatively short bristles set on the outer periphery thereof, and a plurality of magnets fixed in place within the cylindrical sleeve.

2. A cleaning apparatus as claimed in claim 1, in which the support member is made of a magnetic material.

3. A cleaning apparatus as claimed in claim 1, in which the support member includes a receiving portion for collecting undesirable particles removed by the counter member from the belt.

4. A cleaning apparatus as claimed in claim 1, further comprising toner discharging means for discharging the removed toner out of the cleaning apparatus.

5. A cleaning apparatus for cleaning a moving photoconductive belt to remove residual toner therefrom, comprising:

a rotatable cleaning member for removing the residual toner from the imaging surface of the belt;

a counter member located at the side of the belt opposite to the imaging surface to face the cleaning member through the belt; and a support member for supporting the counter member and urging the counter member against the back surface of the belt while the apparatus is operated;

the counter member comprising a block of relatively soft material which is at least one of felt, rubber and sponge.

6. A cleaning apparatus for cleaning a moving photoconductive belt to remove residual toner therefrom, comprising:

a rotatable cleaning member for removing the residual toner from the imaging surface of the belt;

a counter member located at the side of the belt opposite to the imaging surface to face the cleaning member through the belt;

a support member for supporting the counter member and urging the counter member against the back surface of the belt while the apparatus is operated; and a base for allowing the support member to rest thereon.

7. A cleaning apparatus as claimed in claim 6, in which the support member and the base are formed integrally with each other.

8. A cleaning apparatus as claimed in claim 7, further comprising a magnetic plate which is adhered to the integral support member and base.

9. A cleaning apparatus as claimed in claim 6, in which the base is formed with a receiving portion for receiving the support member therein.

10. A cleaning apparatus as claimed in claim 9, in which the receiving portion also functions to position the support member relative to the cleaning member and to collect undesirable particles removed by the counter member from the belt.

11. A cleaning apparatus as claimed in claim 9, in which the receiving portion of the base is constituted by a recess.

12. A cleaning apparatus as claimed in claim 9, in which the receiving portion of the base comprises two spaced recesses one of which functions to position the support member relative to the cleaning member and the other to collect undesirable particles removed by the counter member from the belt.

13. A cleaning apparatus as claimed in claim 12, in which said other recess is partly slanted to prevent the support member from being contaminated by the collected undesirable particles.

14. A cleaning apparatus as claimed in claim 9, in which the counter member comprises relatively short bristles set thereon and made of a relatively soft material.

15. A cleaning apparatus as claimed in claim 7, in which the counter member comprises relatively short bristles set thereon and made of a relatively soft material.

16. A cleaning apparatus as claimed in claim 4, in which the toner discharging means comprises a screw and a discharge casing through which the removed toner is fed from the cleaning apparatus.

* * * * *